US009673559B1

(12) United States Patent
Rossman et al.

(10) Patent No.: US 9,673,559 B1
(45) Date of Patent: Jun. 6, 2017

(54) ELECTRICAL CONNECTOR ASSEMBLY HAVING A MULTI-PIECE BACKSHELL

(71) Applicant: TYCO ELECTRONICS CORPORATION, Berwyn, PA (US)

(72) Inventors: Jared Evan Rossman, Dover, PA (US); Nicholas Lee Evans, Harrisburg, PA (US); Richard Elof Hamner, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/186,913

(22) Filed: Jun. 20, 2016

(51) Int. Cl.

| | |
|---|---|
| ***H01R 13/514*** | (2006.01) |
| ***H01R 13/512*** | (2006.01) |
| ***H01R 13/621*** | (2006.01) |
| ***H01R 12/70*** | (2011.01) |
| ***H01R 43/26*** | (2006.01) |
| *H01R 13/516* | (2006.01) |

(52) U.S. Cl.
CPC ..... *H01R 13/512* (2013.01); *H01R 12/7011* (2013.01); *H01R 13/6215* (2013.01); *H01R 43/26* (2013.01); *H01R 13/516* (2013.01); *Y10S 439/906* (2013.01)

(58) Field of Classification Search
USPC ..... 439/731, 906, 362
See application file for complete search history.

(56) References Cited

U.S. PATENT DOCUMENTS

| | | | | |
|---|---|---|---|---|
| 5,219,242 A * | 6/1993 | Liaw | ..... | H01R 13/516 403/24 |
| 5,314,357 A * | 5/1994 | Weidler | ..... | H01R 13/518 439/680 |
| 5,480,329 A * | 1/1996 | Karlstrom | ..... | H01R 13/508 439/362 |
| 8,062,054 B2 * | 11/2011 | Su | ..... | H01R 13/502 439/362 |

FOREIGN PATENT DOCUMENTS

| | | | | |
|---|---|---|---|---|
| WO | WO87/07088 | * 11/1987 | ..... | H01R 13/516 |

* cited by examiner

*Primary Examiner* — Tho D Ta

(57) ABSTRACT

A backshell includes an upper shell, a lower shell and a fastener coupled to the upper shell and coupled to the lower shell to hold the upper shell and the lower shell together and resist separation of the upper shell from the lower shell. The upper shell defines a portion of a cavity of the backshell and includes a top wall and an upper shell side wall extending from the top wall to a bottom of the upper shell. The lower shell defines another portion of the cavity of the backshell. The lower shell includes a bottom wall and a lower shell side wall extending from the bottom wall to a top of the lower shell. The top of the lower shell generally mates with the bottom of the upper shell at a mating plane. The fastener extends along a longitudinal axis generally parallel to the mating plane.

20 Claims, 3 Drawing Sheets

ELECTRICAL CONNECTOR ASSEMBLY HAVING A MULTI-PIECE BACKSHELL

BACKGROUND OF THE INVENTION

The subject matter herein relates generally to electrical connector assemblies having multi-piece backshells.

Electrical connector assemblies are used in many applications. Some electrical connector assemblies include electrical connectors provided at ends of cables. Some cable assemblies use a backshell to house the electrical connectors and portions of the cables. Typically, the backshells are two-piece backshells having a top half and a bottom half that are coupled together using a ferrule and mechanical fasteners, such as threaded screws that pass vertically between the top and bottom shell halves to secure the top shell to the bottom shell. The threaded screws are extra components that must be processed and threadably coupled to the shells during the assembly process, increasing the part count and increasing assembly time and cost of the electrical connector assembly. The screws tend to be small so as to not unnecessarily increase the overall size of the shells, as separate threaded bores need to be provided for the screws. However, the small screws tend to be unreliable and tend to strip easily during assembly, leading to high scrap rates during assembly.

A need remains for a backshell for cable assemblies that can be assembled and disassembled without the use of traditional additional mechanical fasteners.

BRIEF DESCRIPTION OF THE INVENTION

In one embodiment, a backshell for an electrical connector assembly is provided including an upper shell, a lower shell and a fastener coupled to the upper shell and coupled to the lower shell to hold the upper shell and the lower shell together and resist separation of the upper shell from the lower shell. The upper shell defines a portion of a cavity of the backshell and includes a top wall and an upper shell side wall extending from the top wall to a bottom of the upper shell. The lower shell defines another portion of the cavity of the backshell. The lower shell includes a bottom wall and a lower shell side wall extending from the bottom wall to a top of the lower shell. The top of the lower shell generally mates with the bottom of the upper shell at a mating plane. The fastener extends along a longitudinal axis generally parallel to the mating plane.

In another embodiment, an electrical connector assembly is provided including a connector having a housing holding a plurality of contacts. The housing has a mating end configured to be mated to a mating connector along a mating axis. A backshell is provided having a cavity holding the connector. The backshell has a front providing access to the mating end of the mating connector. The backshell includes an upper shell and a lower shell coupled together to form the cavity and surround the connector and a fastener for securing the upper shell to the lower shell. The upper shell includes a top wall and an upper shell side wall extending from the top wall. The lower shell includes a bottom wall and a lower shell side wall extending from the bottom wall. The fastener is received in the upper shell side wall and is received in the lower shell side wall to secure the upper shell side wall to the lower shell side wall. The fastener extends along a longitudinal axis generally parallel to the mating axis.

In a further embodiment, an electrical connector assembly is provided including a connector having a housing holding a plurality of contacts. The housing has a mating end configured to be mated to a mating connector. A backshell has a cavity holding the connector. The backshell has a front providing access to the mating end of the mating connector. The backshell has a jackscrew having a threaded mating end extending forward of the front for securing the backshell to a mating component. The backshell has a guide pin having a head extending forward of the front to guide mating of the backshell with the mating component. The backshell includes an upper shell and a lower shell coupled together to form the cavity and surround the connector. The upper shell includes a top wall and an upper shell side wall extending from the top wall. The lower shell includes a bottom wall and a lower shell side wall extending from the bottom wall. At least one of the jackscrew and the guide pin extends through the upper shell side wall and the lower shell side wall to secure the upper shell side wall to the lower shell side wall.

DETAILED DESCRIPTION OF THE INVENTION

Figure 1:
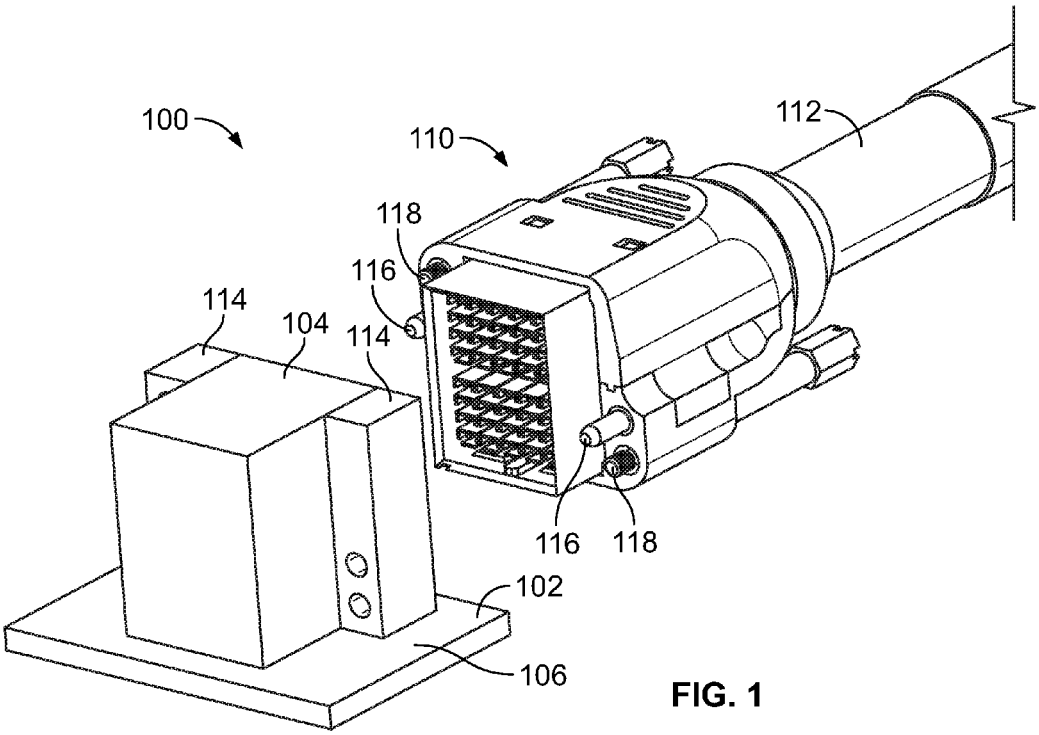
FIG. 1 is a perspective view of a communication system including an electrical connector assembly formed in accordance with an embodiment.

FIG. 1 is a perspective view of a communication system 100 formed in accordance with an embodiment. The communication system 100 includes a circuit board 102 and an electrical connector 104 that is mounted onto a board surface 106 of the circuit board 102. The electrical connector 104 is used for data communication. In an exemplary embodiment, the electrical connector 104 is a receptacle connector used as a mating connector for an electrical connector assembly 110. The electrical connector assembly 110 may be plugged into the mating electrical connector 104 for electrical connection thereto. In the illustrated embodiment, the electrical connector assembly 110 is provided at an end of a wire harness or cable 112.

In some embodiments, the electrical connector 104 may be part of a card assembly, such as a backplane or a daughtercard communication system (not shown). In various embodiments, the communication system 100 may include a plurality of the electrical connectors 104 mounted to the circuit board 102 along an edge of the circuit board 102 in which each of the electrical connectors 104 is configured to engage a corresponding electrical connector assembly 110. In the illustrated embodiment, the mating electrical connector 104 is a right-angle connector such that the front or mating end and the bottom or mounting end are oriented substantially perpendicular or orthogonal to each other. More specifically, the front end faces in a receiving direction for mating with the electrical connector assembly 110 and the mounting end faces the circuit board 102. In other embodiments, the receiving side and the mounting side may face in different directions than those shown in FIG. 1.

In an exemplary embodiment, the communication system 100 includes one or more guide modules 114 to guide mating of the electrical connector assembly 110 to the mating electrical connector 104. In an exemplary embodiment, the guide modules 114 define mating components and may be referred to hereinafter as mating components 114. For example, the electrical connector assembly 110 may include guide pins 116 that are received in the mating components 114 to locate the electrical connector assembly 110 relative to the mating electrical connector 104. The electrical connector assembly 110 may be securely coupled to the mating components 114 to maintain the electrical connection between the electrical connector assembly 110 and the mating electrical connector 104. For example, the electrical connector assembly 110 may be secured to the mating components 114 using threaded jackscrews 118. The mating components 114 may be a structure other than a guide module, such as the mating connector itself, a backplane, a chassis, a panel or another structure.

Figure 2:
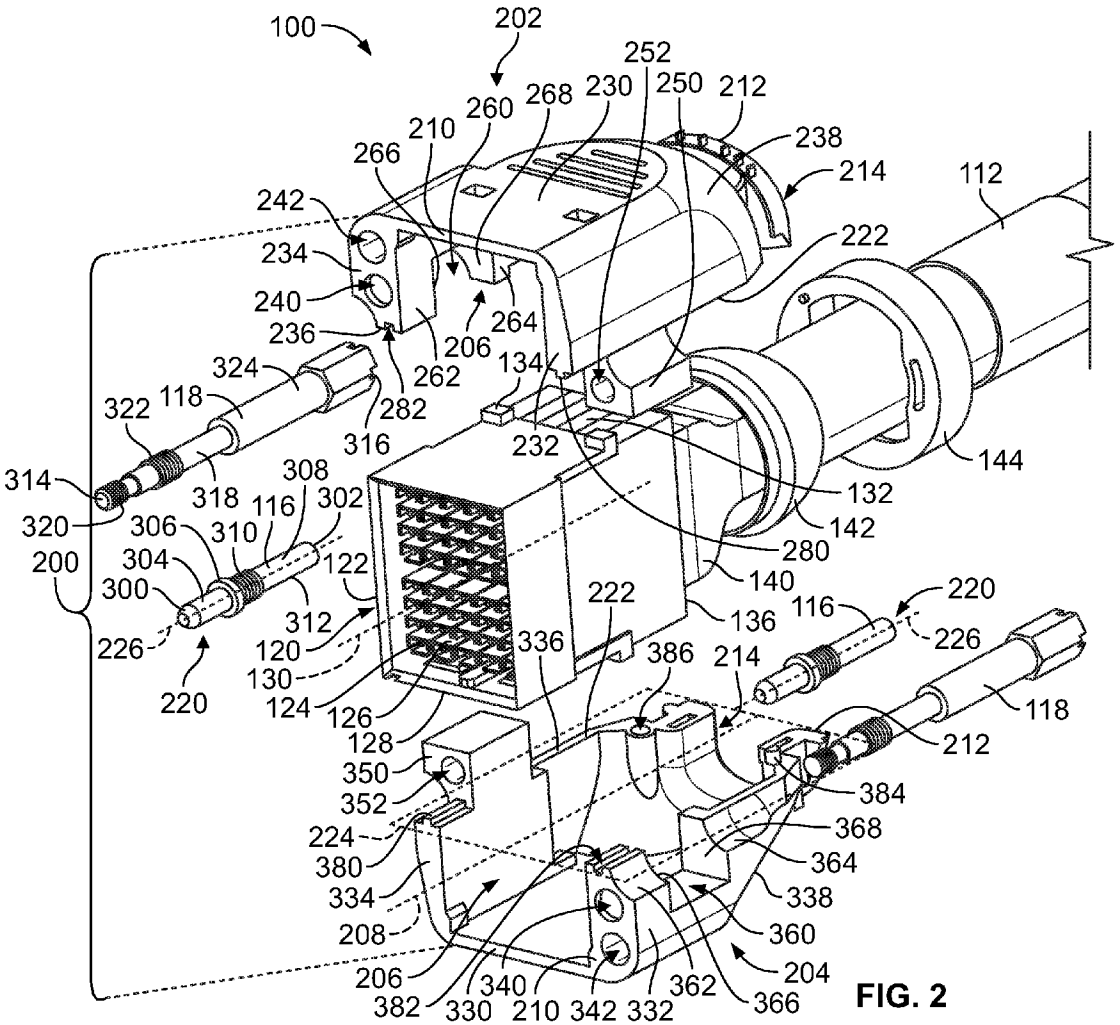
FIG. 2 is an exploded view of the electrical connector assembly formed in accordance with an exemplary embodiment.

FIG. 2 is an exploded view of the electrical connector assembly 110 formed in accordance with an exemplary embodiment. The electrical connector assembly 110 includes a connector 120 provided at the end of the cable 112 and a backshell 200 surrounding and holding the connector 120. The backshell 200 may be used to protect the connector 120. The backshell 200 may provide electrical shielding for the connector 120. The backshell 200 may be used to mechanically secure the connector 120 to the mating electrical connector 104 (shown in FIG. 1) when the backshell 200 is coupled to the guide modules 114 (shown in FIG. 1).

The connector 120 has a housing 122 holding a plurality of contacts 124. In an exemplary embodiment, the connector 120 includes a plurality of ground contacts 126 surrounding corresponding contacts 124, such as pairs of the contacts 124. The housing 122 has a mating end 128 configured to be mated to the mating electrical connector 104 along a mating axis 130. In the illustrated embodiment, the connector 120 includes a plurality of contact modules 132 received in the back end of the housing 122. The contact modules 132 may hold corresponding contacts 124, 126. The contact modules 132 may be arranged in a stacked configuration at the back end of the housing 122. Wires of the cable 112 are terminated to corresponding contacts 124, 126 within the contact modules 132. Optionally, the contact modules 132 may be overmolded over the contacts 124, 126 and/or the wires of the cable 112. In an exemplary embodiment, the housing 122 includes lugs 134 extending from the top and the bottom of the housing 122 and/or the sides of the housing 122 for locating the housing 122 within the backshell 200.

The connector 120 has a cable end 136 opposite the mating end 128 of the housing 122. The cable 112 extends from the cable end 136. In an exemplary embodiment, the cable 112 includes a cable braid 140 surrounding the individual wires (not shown) of the cable 112 and providing electrical shielding for the wires of the cable 112. The cable 112 includes a cable jacket 142 surrounding the cable braid 140. In an exemplary embodiment, the cable braid 140 may be electrically terminated to the backshell 200. The cable jacket 142 may be dressed over the back end of the backshell 200. Optionally, a ferrule 144 may be provided as a strain relief at the connection of the cable 112 to the backshell 200. For example, the ferrule 144 may be provided over the cable jacket 142 to secure the cable jacket 142 to the backshell 200.

The backshell 200 includes an upper shell 202 and a lower shell 204 coupled to the upper shell 202. The backshell 200 includes a cavity 206 defined by the upper and lower shells 202, 204. The cavity 206 extends along a cavity axis 208 between a mating end or front 210 of the backshell 200 and a cable end or rear 212 of the backshell 200. The backshell 200 defines a cable exit 214 at the rear 212. The connector 120 is received in the cavity 206 and the cable 112 exits the cavity 206 of the backshell 200 through the cable exit 214. In an exemplary embodiment, the cavity axis 208 is generally parallel to the mating axis 130 of the connector 120.

In an exemplary embodiment, the upper and lower shells 202, 204 are approximately equal portions of the backshell 200, such as defining approximately equal portions of the cavity 206. In alternative embodiments, the upper shell 202 may define a majority of the backshell 200 or the lower shell 204 may define a majority of the backshell 200. However, in the illustrated embodiment, the upper and lower shells 202, 204 are identical shells inverted and configured to be coupled together. Optionally, the upper and lower shells 202, 204 may be hermaphroditic including mating portions that are interested when assembled.

The backshell 200 includes a pair of the jackscrews 118 arranged on opposite sides of the backshell 200 used to threadably couple the electrical connector assembly 110 to the guide modules 114. In an exemplary embodiment, one of the jackscrews 118 is loaded through the upper shell 202 while another of the jackscrews 118 is loaded through the lower shell 204. The jackscrews 118 are accessible rearward of the backshell 200 to threadably couple or uncouple the jackscrews 118 to the guide modules 114.

The backshell 200 includes a pair of the guide pins 116 to guide mating of the electrical connector assembly 110 to the mating electrical connector 104. For example, the guide pins 116 may be received in corresponding guide modules 114. In an exemplary embodiment, one of the guide pins 116 is received in the upper shell 202 while the other guide pin 116 is received in the lower shell 204. In an exemplary embodiment, at least one of the guide pins 116 and/or at least one of the jackscrews 118 is used as a fastener 220 to couple the upper shell 202 and the lower shell 204 together and resist separation of the upper shell 202 from the lower shell 204. In the illustrated embodiment, as described in further detail below, both guide pins 116 define fasteners 220. However, in alternative embodiments, the jackscrews 118 may be used to define the fasteners 220.

In an exemplary embodiment, the upper and lower shells 202, 204 meet at a seam 222 along a mating plane 224. The mating plane 224 is defined at the interface between the bottom of the upper shell 202 and the top of the lower shell 204. The portion of the cavity 206 defined by the upper shell 202 is provided above the mating plane 224 and the portion of the cavity 206 defined by the lower shell 204 is below the mating plane 224. Optionally, portions of the upper shell 202 may extend across the mating plane 224 and/or portions of the lower shell 204 may extend across the mating plane 224. Optionally, one of the fasteners 220 may be provided above the mating plane 224 and another of the fasteners 220 may be provided below the mating plane 224. Optionally, one of the guide pins 116 may be provided above the mating plane 224 and another of the guide pins 116 may be provided below the mating plane 224. Optionally, one of the jackscrews 118 may be provided above the mating plane 224 and another of the jackscrews 118 may be provided below the mating plane 224.

In an exemplary embodiment, the fasteners 220 used to secure the upper and lower shells 202, 204 together extends along a longitudinal axis 226 generally parallel to the mating plane 224. Having the fasteners 220 defined by the guide pins 116 and/or the jackscrews 118 utilizes existing components to serve more than one function, thus eliminating additional components, such as additional threaded fasteners used only to secure the upper and lower shells 202, 204 together. For example, by using the guide pins 116 to define the fasteners 220 or by using the jackscrews 118 to define the fasteners 220, additional threaded fasteners are not needed to secure the upper shell 202 to the lower shell 204. For example, the backshell 200 does not need guide pins, jackscrews and additional threaded fasteners, but rather only needs the guide pins 116 or the jackscrews 118 to additionally accomplish securing the upper shell 202 to the lower shell 204 using the guide pins 116 as the fasteners 220 or the jackscrews 118 as the fasteners 220. Assembly may be easier or less time consuming by using fewer parts. In other various embodiments, all three functions may be performed by a single component. For example, the fastener 220 may be used as a jackscrew to secure the backshell 200 to the guide modules 114 while including a guide pin tip forward of the threaded mating end to guide mating prior to engaging the threaded mating area. Such fastener would also extend through both the upper and lower shells 202, 204 to secure the upper and lower shells 202, 204 together.

The upper shell 202 includes a top wall 230, a first upper shell side wall 232 and a second upper shell side wall 234 extending from the top wall 230. The side walls 232, 234 extend downward from the top wall 230 to a bottom 236 of the upper shell 202. Optionally, the side walls 232, 234 may extend generally parallel to the cavity axis 208 from the front 210 to a rear cavity wall 238 proximate to the rear 212. The side walls 232, 234 may be tapered inward from the rear cavity wall 238 to define the cable exit 214. Optionally, the first upper shell side wall 232 may be thinner than the second upper shell side wall 234. For example, the second upper shell side wall 234 may include a first channel 240 and a second channel 242 that receive the guide pin 116 and the jackscrew 118, respectively. For example, the first channel 240 may be a guide pin channel configured to receive the guide pin 116. The second channel 242 may be a jackscrew channel configured to receive the jackscrew 118. The second upper shell side wall 234 is thicker to accommodate the channels 240, 242.

The first upper shell side wall 232 includes a lug 250 extending therefrom. The lug 250 extends downward from the bottom 236 of the upper shell 202. The lug 250 extends beyond the mating plane 224. The lug 250 is configured to be received in the lower shell 204. One of the fasteners 220 may be coupled to the lug 250 to secure the upper shell 202 to the lower shell 204. The lug 250 includes a channel 252 therein. The channel 252 receives a portion of the fastener 220.

The second upper shell side wall 234 includes a pocket 260 open at the bottom 236 configured to receive a portion of the lower shell 204. The second upper shell side wall 234 includes a front brace 262 forward of the pocket 260 and a rear brace 264 rearward of the pocket 260. The braces 262, 264 include end walls 266, 268, respectively, facing and defining the pocket 260. The channels 240, 242 extend through the front brace 262 and may extend at least partially through the rear brace 264.

In an exemplary embodiment, the upper shell 202 includes a plurality of locating features for locating the upper shell 202 relative to the lower shell 204. For example, the upper shell 202 may include a rib 280 along the first upper shell side wall 232, such as forward of the lug 250. The second upper shell side wall 234 may include a groove 282 at the bottom 236, such as along the front brace 262. The upper shell 202 may include other types of locating fixtures, such as posts, openings, or other features. The locating features may be used to hold side-to-side locations of the upper shell 202 relative to the lower shell 204.

The guide pin 116 extends between a front 300 and a rear 302. The guide pin 116 includes a head 304 at the front 300 configured to extend forward of the backshell 200 to guide mating of the electrical connector assembly 110 with the mating electrical connector 104. A flange 306 is provided rearward of the head 304. The guide pin 116 includes a shaft 308 extending to the rear 302. In an exemplary embodiment, the shaft 308 includes a threaded area 310. Optionally, the threaded area 310 may be immediately rearward of the flange 306 for threadably coupling to the front brace 262. Alternatively, the threaded area 310 may be provided remote from the flange 306, such as at or near the rear 302 for threadably coupling to the lug 350 of lower shell 204. In the illustrated embodiment, the shaft 308 defines a tail 312 rearward of the threaded area 310.

The guide pin 116 is configured to be threadably coupled to the backshell 200. For example, the guide pin 116 may be received in the guide pin channel 240 and threadably coupled to the upper shell 202 in the guide pin channel 240. Alternatively, the guide pin 116 may be threadably coupled to the lug 350 in the channel 352. Tightening of such guide pin 116 may pull or cinch the lug 350 forward against the front brace 262, which may securely couple the upper and lower shells 202, 204 and resist movement therebetween. The flange 306 may abut against the front brace 262 when the guide pin 116 is fully threadably inserted into the channel 240. The head 304 may extend forward of the front brace 262. In an exemplary embodiment, the tail 312 extends rearward of the front brace 262 into the pocket 260 to engage the portion of the lower shell 204 received in the pocket 260. As such, the guide pin 116 is configured to be coupled to both the upper shell 202 and the lower shell 204 to hold the shells 202, 204 together and resist separation of the upper shell 202 from the lower shell 204.

The jackscrew 118 extends between a front 314 and a rear 316. The jackscrew 118 includes a shaft 318 extending between the front 314 and the rear 316. The jackscrew 118 includes a threaded mating end 320 at the front 314. The threaded mating end 320 may be threadably coupled to the guide module 114 to secure the backshell 200 to the guide module 114. In an exemplary embodiment, the shaft 318 includes a threaded area 322 and a head 324 rearward of the threaded area 322. The jackscrew 118 is configured to be received in the jackscrew channel 242 such that the jackscrew 118 is captured in the jackscrew channel 242 between the threaded area 322 and the head 324. The jackscrew 118 may be captured in the upper shell 202 such that the jackscrew 118 is freely rotatable relative to the upper shell 202; however, the jackscrew 118 may be removed from the upper shell 202 by unthreading the threaded area 322 as the jackscrew 118 is pulled rearward.

The lower shell 204 includes a bottom wall 330, a first lower shell side wall 332 and a second lower shell side wall 334 extending from the bottom wall 330. The side walls 332, 334 extend upward from the bottom wall 330 to a top 336 of the lower shell 204. Optionally, the side walls 332, 334 may extend generally parallel to the cavity axis 208 from the front 210 to a rear cavity wall 338 proximate to the rear 212. The side walls 332, 334 may be tapered inward from the rear cavity wall 338 to define the cable exit 214. Optionally, the first lower shell side wall 332 may be thicker than the second lower shell side wall 334. For example, the first lower shell side wall 332 may include a first channel 340 and a second channel 342 that receive the guide pin 116 and the jackscrew 118, respectively. For example, the first channel 340 may be a guide pin channel configured to receive the guide pin 116. The second channel 342 may be a jackscrew channel configured to receive the jackscrew 118. The first lower shell side wall 332 is thicker to accommodate the channels 340, 342.

The second lower shell side wall 334 includes a lug 350 extending therefrom. The lug 350 extends upward from the top 336 of the lower shell 204. The lug 350 extends beyond the mating plane 224. The lug 350 is configured to be received in the upper shell 202. One of the fasteners 220 may be coupled to the lug 350 to secure the upper shell 202 to the lower shell 204. The lug 350 includes a channel 352 therein. The channel 352 receives a portion of the fastener 220.

The first lower shell side wall 332 includes a pocket 360 open at the top 336 configured to receive a portion of the upper shell 204. The first lower shell side wall 332 includes a front brace 362 forward of the pocket 360 and a rear brace 364 rearward of the pocket 360. The braces 362, 364 include end walls 366, 368, respectively facing and defining the pocket 360. The channels 340, 342 extend through the front brace 362 and may extend through the rear brace 364.

In an exemplary embodiment, the lower shell 204 includes a plurality of locating features for locating the lower shell 204 relative to the upper shell 202. For example, the lower shell 204 may include a rib 380 along the second lower shell side wall 334, such as forward of the lug 350. The rib 380 is received in the groove 282 of the upper shell 202. The first lower shell side wall 332 may include a groove 382 at the top 336, such as along the front brace 362. The groove 382 receives the rib 280 of the upper shell 202. In an exemplary embodiment, the lower shell 204 includes a post 384 at the first lower shell side wall 332 and an opening 386 at the second lower shell side wall 334. The post 384 may be received in a corresponding opening (not shown) in the upper shell 202 and the opening 386 may receive a corresponding post (not shown) of the upper shell 202. The post 384 and the opening 386 are provided at the rear cavity wall 338. The locating features may be used to hold side-to-side locations of the upper shell 202 relative to the lower shell 204.

Figure 3:
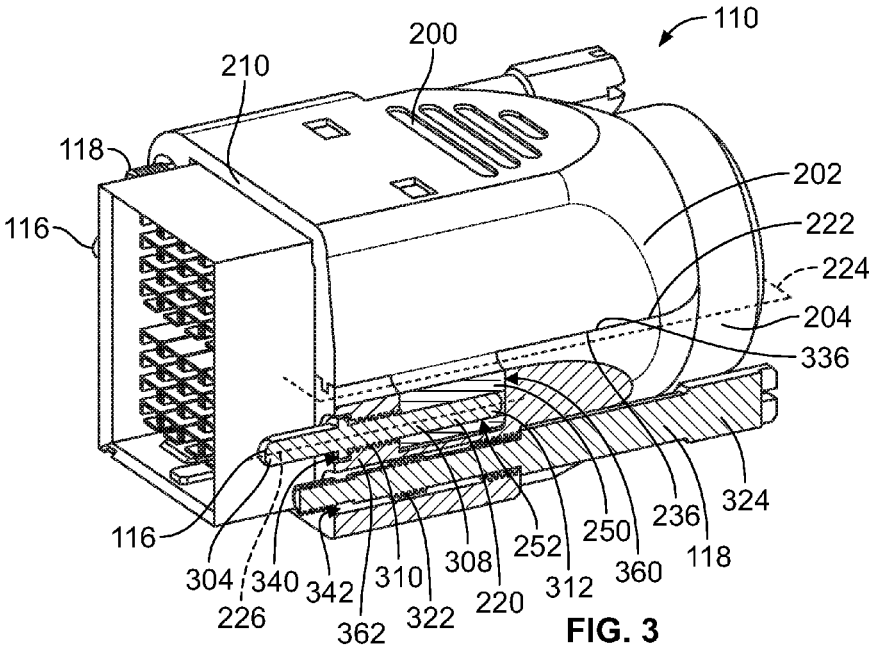
FIG. 3 is a partial sectional view of the electrical connector assembly.

FIG. 3 is a partial sectional view of the electrical connector assembly 110 formed in accordance with an exemplary embodiment. FIG. 3 illustrates the fastener 220 (the guide pin 116 in the illustrated embodiment) securing the upper shell 202 to the lower shell 204. When assembled, the bottom 236 of the upper shell 202 rests on the top 336 of the lower shell 204 at the seam 222 defining the mating plane 224. The lug 250 of the upper shell 202 is received in the pocket 360 of the lower shell 204. The channel 340 in the front brace 362 of the lower shell 204 is aligned with the channel 252 in the lug 250 of the upper shell 202. The fastener 220 is received in the channels 340, 252 to hold the upper shell 202 and the lower shell 204 together and resist separation of the upper shell 202 from the lower shell 204.

The fastener 220 extends along the longitudinal axis 226 generally parallel to the mating plane 224. The threaded area 310 of the fastener 220 is threadably coupled to the front brace 362 in the channel 340. The tail 312 of the shaft 308 extends rearward of the front brace 362 into the channel 252 of the lug 250. Optionally, the channel 252 may have a chamfered lead-in to prevent stubbing during loading of the fastener 220 into the backshell 200. The tail 312 may fit in the channel 340 by a tight fit to resist up-and-down or side-to-side movement of the upper shell 202 relative to the lower shell 204.

The fastener 220 on the other side of the backshell 200 is held in a similar manner passing through both the upper shell 202 and the lower shell 204 to hold the shells 202, 204 together and resist separation of the shells 202, 204. In the illustrated embodiment, the fasteners 220 are defined by the guide pins 116. The guide pins 116 are loaded into the channels 340 through the front 210 of the backshell 200 such that the heads 304 of the guide pins 116 extend forward of the front 210.

The jackscrew 118 is coupled to the lower shell 204 and is configured to be rotatably coupled to the guide module 114 (shown in FIG. 1) to secure the backshell 200 to the guide module 114. The jackscrew 118 may be loaded through the rear of the second channel 342 until the head 324 bottoms out against the lower shell 204. The head 324 of the jackscrew 118 protrudes rearward of the backshell 200 for access and tightening or untightening of the jackscrew 118 during mating or unmating with the guide module 114. In an exemplary embodiment, the second channel 342 is threaded at the rear end such that the threaded area 322 of the jackscrew 118 may be threaded through the threaded area of the second channel 342. Optionally, in various alternative embodiments, the jackscrew 118 may pass through a portion of the upper shell 202, such as the lug 250, such that the jackscrew 118 defines a fastener used to hold the shells 202, 204 together.

Figure 4:
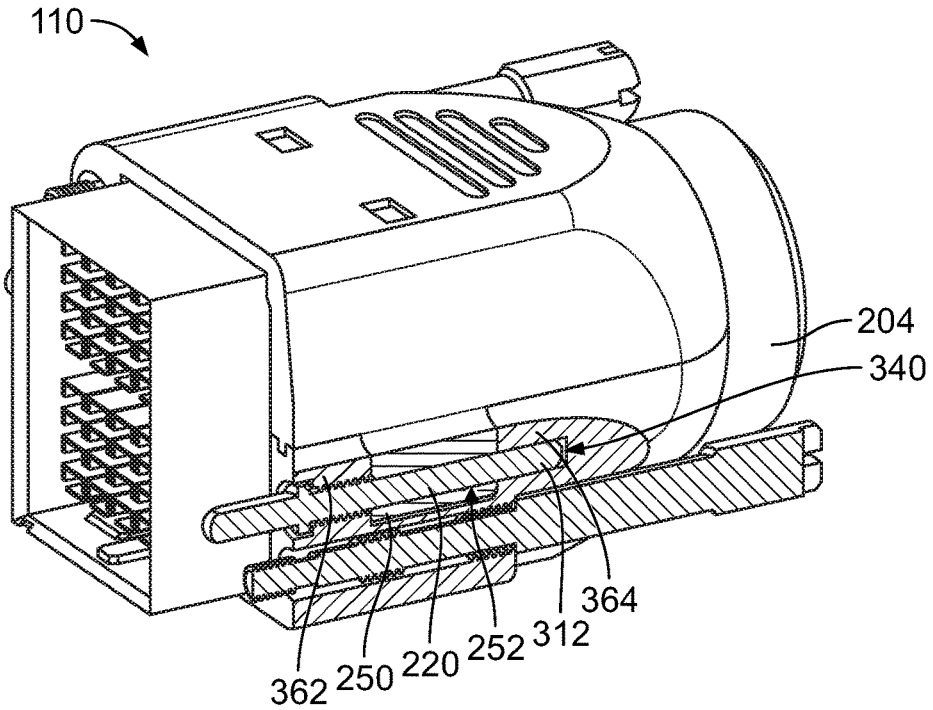
FIG. 4 is a partial sectional view of the electrical connector assembly in accordance with an exemplary embodiment.

FIG. 4 is a partial sectional view of the electrical connector assembly 110 in accordance with an exemplary embodiment. In the illustrated embodiment, the rear brace 364 of the lower shell 204 includes a portion of the guide pin channel 340 that receives a portion of the fastener 220. For example, the tail 312 passes entirely through the channel 252 in the lug 250 of upper shell 202 into the channel 340 in the rear brace 364. As such, the fastener 220 is supported by the front brace 362 and the rear brace 364 while passing through the channel 252 in the lug 250. The fastener 220 may be more securely held in the backshell 200 by such an arrangement.

Figure 5:
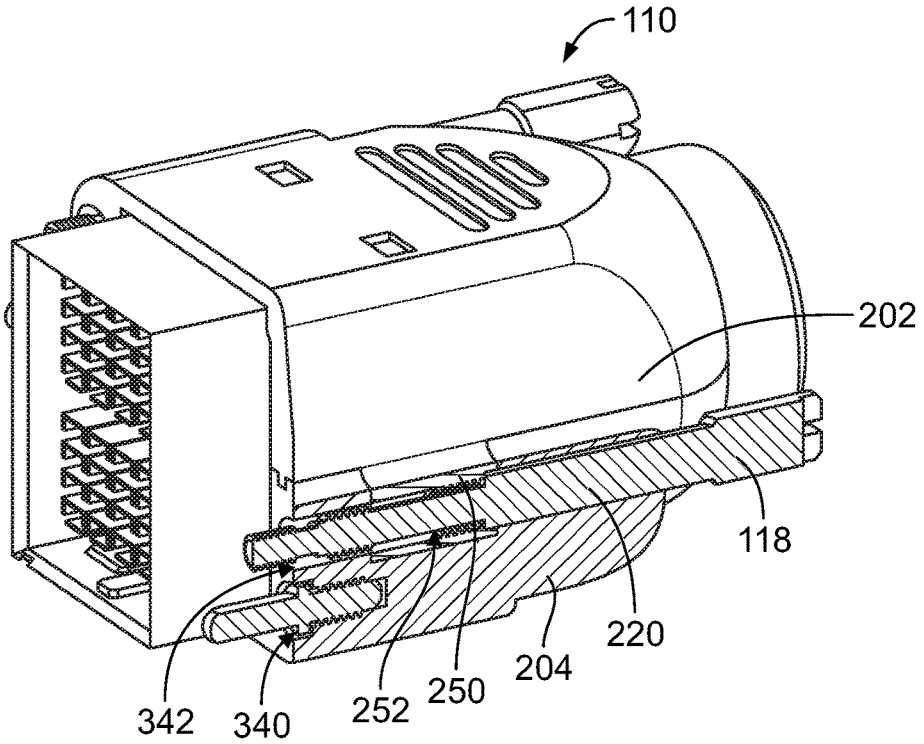
FIG. 5 is a partial sectional view of the electrical connector assembly in accordance with an exemplary embodiment.

FIG. 5 is a partial sectional view of the electrical connector assembly 110 in accordance with an exemplary embodiment. FIG. 5 illustrates the jackscrew 118 as the fastener 220. The jackscrew 118 extends through the lower shell 204 and the upper shell 202. For example, the jackscrew 118 passes through the channel 252 in the lug 250. In the illustrated embodiment, the channel 252 in the lug 250 is aligned with the jackscrew channel 342, which is located above the guide pin channel 340 in the illustrated embodiment. Using the jackscrew 118 to hold the shells 202, 204 together eliminates the need for separate threaded fasteners in addition the jackscrew 118 or the guide pin 116.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A backshell for an electrical connector assembly, the backshell comprising:

an upper shell defining a portion of a cavity of the backshell, the upper shell including a top wall and an upper shell side wall extending from the top wall to a bottom of the upper shell; and a lower shell coupled to the upper shell and defining a portion of the cavity of the backshell, the lower shell including a bottom wall and a lower shell side wall extending from the bottom wall to a top of the lower shell, wherein the top of the lower shell generally mates with the bottom of the upper shell at a mating plane, wherein at least one of the upper shell and the lower shell includes a lug extending from the corresponding upper shell side wall or the lower shell side wall, at least one of the upper shell and the lower shell includes a pocket formed in the corresponding upper shell side wall or the lower shell side wall, the pocket receiving the corresponding lug; and a fastener coupled to the upper shell and coupled to the lower shell to hold the upper shell and the lower shell together and resist separation of the upper shell from the lower shell, the fastener extending along a longitudinal axis generally parallel to the mating plane through the lug.

2. The backshell of claim 1, wherein the backshell includes a front between the top wall and the bottom wall and a cable exit opposite the front, the cavity extending along a cavity axis between the front and the cable exit, the longitudinal axis being generally parallel to the cavity axis.

3. The backshell of claim 1, wherein the fastener extends forward of a front of the upper shell, the fastener being configured to be mated with a mating component mated to the backshell.

4. The backshell of claim 1, wherein the fastener comprises a guide pin extending forward of the upper shell to guide mating of the backshell with a mating component.

5. The backshell of claim 1, wherein the fastener comprises a jackscrew extending forward of the upper shell configured to be threadably coupled to a mating component.

6. The backshell of claim 1, wherein the upper shell side wall includes a channel and the lower shell side wall includes a channel axially aligned with the channel of the upper shell side wall, the channels receiving the fastener to hold the relative positions of the upper shell and the lower shell.

7. The backshell of claim 1, wherein the upper shell and the lower shell are identical shells inverted and coupled together by the fastener.

8. The backshell of claim 1, wherein the upper shell side wall includes the lug extending from the bottom, the lower shell side wall includes the pocket receiving the lug and a front brace forward of the pocket, the fastener passing through the front brace into the lug to hold the upper shell and the lower shell together.

9. The backshell of claim 8, wherein the lower shell side wall includes a rear brace rearward of the pocket being axially aligned with the front brace and the pocket, the fastener passing through the lug into the rear brace to hold the upper shell and the lower shell together.

10. The backshell of claim 8, wherein the fastener is threadably coupled to the front brace.

11. The backshell of claim 8, wherein the fastener is threadably coupled to the lug.

12. The backshell of claim 8, wherein the front brace includes a channel and the lug includes a channel axially aligned with the channel of the front brace, the channels receive the fastener to hold the relative positions of the upper shell and the lower shell.

13. The backshell of claim 8, wherein the upper shell includes a second upper shell side wall extending from the top wall, the second upper shell side wall includes a pocket and a front brace forward of the pocket, the lower shell includes a second lower shell side wall extending from the bottom wall, the second lower shell side wall includes a lug extending from the top, the lug of the second lower shell side wall being received in the pocket of the second upper shell side wall, the backshell further comprising a second fastener passing through the front brace of the second upper shell side wall and the lug of the second lower shell side wall to hold the upper shell and the lower shell together.

14. The backshell of claim 8, wherein the upper shell includes a second upper shell side wall extending from the top, the second upper shell side wall includes a lug extending from the bottom of the upper shell, the lower shell includes a second lower shell side wall extending from the bottom wall, the second lower shell side wall includes a pocket and a front brace forward of the pocket, the lug of the second upper shell side wall being received in the pocket of the second lower shell side wall, the backshell further comprising a second fastener passing through the front brace of the second lower shell side wall and the lug of the second upper shell side wall to hold the upper shell and the lower shell together.

15. The backshell of claim 1, wherein the upper shell side wall includes the lug extending from the bottom, the lower shell side wall includes the pocket receiving the lug and a rear brace rearward of the pocket, the fastener passing at least partially through the rear brace and at least partially through the lug to hold the upper shell and the lower shell together.

16. An electrical connector assembly comprising:

a connector having a housing holding a plurality of contacts, the housing having a mating end configured to be mated to a mating connector along a mating axis; and a backshell having a cavity holding the connector, the backshell having a front providing access to the mating end of the mating connector, the backshell comprising an upper shell and a lower shell coupled together to form the cavity and surround the connector, the backshell comprising a fastener securing the upper shell to the lower shell, the upper shell including a top wall and an upper shell side wall extending from the top wall, the lower shell including a bottom wall and a lower shell side wall extending from the bottom wall, wherein at least one of the upper shell and the lower shell includes a lug extending from the corresponding upper shell side wall or the lower shell side wall, at least one of the upper shell and the lower shell includes a pocket formed in the corresponding upper shell side wall or the lower shell side wall, the pocket receiving the corresponding lug, the fastener being received in the upper shell side wall and being received in the lower shell side wall to secure the upper shell side wall to the lower shell side wall, the fastener extending along a longitudinal axis generally parallel to the mating axis through the lug.

17. The electrical connector assembly of claim 16, wherein the fastener extends forward of a front of the upper shell, the fastener being configured to be mated with a mating component mated to the backshell.

18. The electrical connector assembly of claim 16, wherein the upper shell side wall includes a channel and the lower shell side wall includes a channel axially aligned with the channel of the upper shell side wall, the channels being parallel to the mating axis, the channels receiving the fastener to hold the relative positions of the upper shell and the lower shell.

19. The electrical connector assembly of claim 16, wherein the upper shell side wall includes the lug extending from the bottom, the lower shell side wall includes the pocket receiving the lug and a front brace forward of the pocket, the fastener passing through the front brace into the lug to hold the upper shell and the lower shell together.

20. An electrical connector assembly comprising:

a connector having a housing holding a plurality of contacts, the housing having a mating end configured to be mated to a mating connector; and a backshell having a cavity holding the connector, the backshell having a front providing access to the mating end of the mating connector, the backshell having a jackscrew having a threaded mating end extending forward of the front for securing the backshell to a mating component, the backshell having a guide pin having a head extending forward of the front to guide mating of the backshell with the mating component, the backshell comprising an upper shell and a lower shell coupled together to form the cavity and surround the connector, the upper shell including a top wall and an upper shell side wall extending from the top wall, the lower shell including a bottom wall and a lower shell side wall extending from the bottom wall, wherein at least one of the upper shell and the lower shell includes a lug extending from the corresponding upper shell side wall or the lower shell side wall, at least one of the upper shell and the lower shell includes a pocket formed in the corresponding upper shell side wall or the lower shell side wall, the pocket receiving the corresponding lug;

wherein at least one of the jackscrew and the guide pin extends through the upper shell side wall and the lower shell side wall and through the lug to secure the upper shell side wall to the lower shell side wall.

* * * * *